United States Patent [19]

Grondin

[11] Patent Number: 5,003,128

[45] Date of Patent: Mar. 26, 1991

[54] ELECTRICAL SWITCH AND OUTLETS PROTECTING COVER FOR PAINTING

[76] Inventor: Yvan Grondin, 209, 6th Avenue, Province of Quebec, Saint-Francois, Canada, G0M 1AO

[21] Appl. No.: 270,516

[22] Filed: Nov. 8, 1988

[51] Int. Cl.[5] ..... B05C 11/00

[52] U.S. Cl. ..... 174/67; 16/DIG. 2; 118/505; 220/3; 220/4; 439/135; D8/14

[58] Field of Search ..... 174/66, 67; 220/3.3, 220/3.4, 3.5; 439/135; 118/504, 505; 16/DIG. 2; D8/14

[56] References Cited

U.S. PATENT DOCUMENTS

| | | | |
|---|---|---|---|
| D. 279,860 | 7/1985 | Schwalbe | D8/14 |
| D. 297,396 | 8/1988 | Schwalbe | D8/14 |
| 2,925,064 | 2/1960 | Kahn | 118/505 |
| 3,386,071 | 5/1968 | Allen | 16/DIG. 2 |
| 4,656,058 | 4/1987 | Stark | 118/505 X |

*Primary Examiner*—Leo P. Picard
*Assistant Examiner*—David A. Tone

[57] ABSTRACT

This cover fits over and removably adheres to a wall-mounted electrical box or to an electrical component fixed to the box. The protecting cover is used, instead of masking tape, to protect the electrical elements from being soiled with paint during spray-gun painting.

1 Claim, 2 Drawing Sheets

ELECTRICAL SWITCH AND OUTLETS PROTECTING COVER FOR PAINTING

FIELD OF THE INVENTION

The present invention relates generally to wall painting, more specifically to a cover for wall-mounted electrical switches, outlets and thermostats, adapted to protect the latter from paint.

BACKGROUND OF THE INVENTION

Painting walls is nowadays often done with a "paint gun" both to save time, as compared to brushes and rollers, and also to provide a smoother finish.

Preparing a wall for such spray painting involves concealing items, such as electrical switches, etc., as mentioned above. Till now the usual means of concealment has been masking tape, the latter has many well-known disadvantages:

(1) it is time-consuming to apply;

(2) there is a danger of electric shock when the tape is applied with a knife.

(3) the tape tears easily;

(4) residual dust in the electrical box may be blown out by the paint gun; (5) the wires of the outlet switch, etc. can be easily blotched with paint; (6) a workman may easily get paint on his hands when the tape is removed;

(7) there is a fire hazard created by shreds of removed tape left in the electrical box.

OBJECTS OF THE INVENTION

In view of the above, it is a prime object of the present invention to provide a cover for wall painting which obviates all of the above-mentioned disadvantages.

It is another object of the present invention to provide a cover of the above type, which may be used any number of times.

SUMMARY OF THE INVENTION

The above and other objects and advantages of the present invention are realized according to a first embodiment, comprising a rectangularly-dimensioned cover, preferably made of a one-piece molded plastic. The four corners of the inner surface of the cover are provided with electrical-box adhering means, such as, preferably, permanent magnets. The cover is integrally formed with a first raised portion, rectangular in shape and adapted to fit over an electrical outlet or switch box. The cover is further formed with a second raised portion adapted to allow for the switch finger in the case where the device to be covered is an electrical switch.

According to a second embodiment, the cover may be used to protect a standard thermostast. The latter normally have a control knob of any one of two standard diameters. The cover again has a rectangular raised portion, but in this embodiment, the second raised portion is replaced by a pair of cylindrically-shaped bubbles of two different sizes. Any selected bubble constitutes the adhering means. Such is achieved by making the internal diameter of each bubble of a size to frictionally grasp and retain a thermostat knob of a given size.

In both embodiments, the length and width of the cover are made preferably slightly smaller than the standard length and width of a wall plaque, so that there will be no unpainted perimeter when the wall plaque, or the thermostat cover, is reapposed after painting is completed.

BRIEF DESCRIPTION OF THE DRAWINGS

The above will be more clearly understood by having referral to the preferred embodiments of the invention, illustrated by way of the accompanying drawings, in which.

DETAILED DESCRIPTION OF TWO PREFERRED EMBODIMENTS

Figure 1:
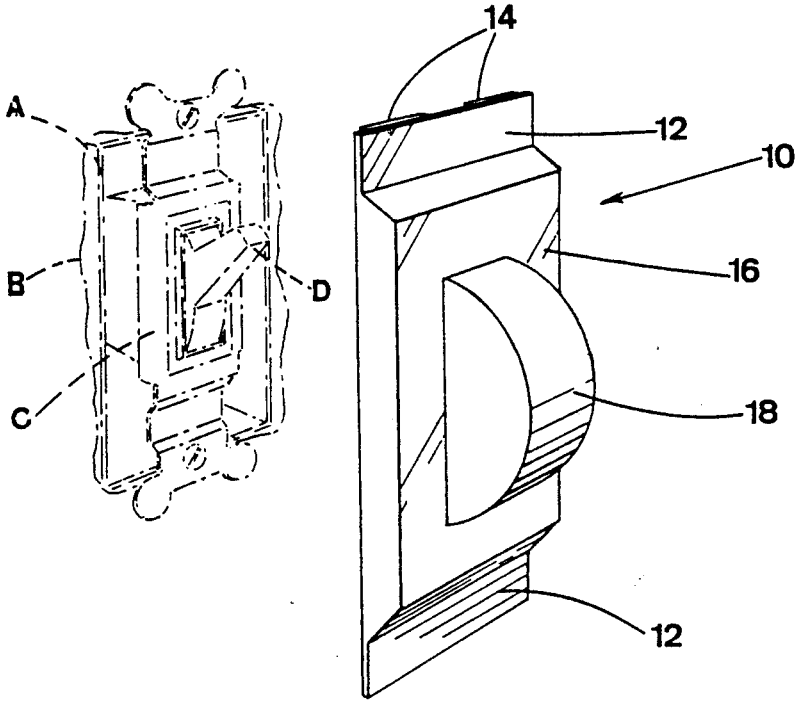
FIG. 1 is a perspective view of a first embodiment of the cover according to the invention, also showing in dashed outline an electrical switch box.
Figure 3:
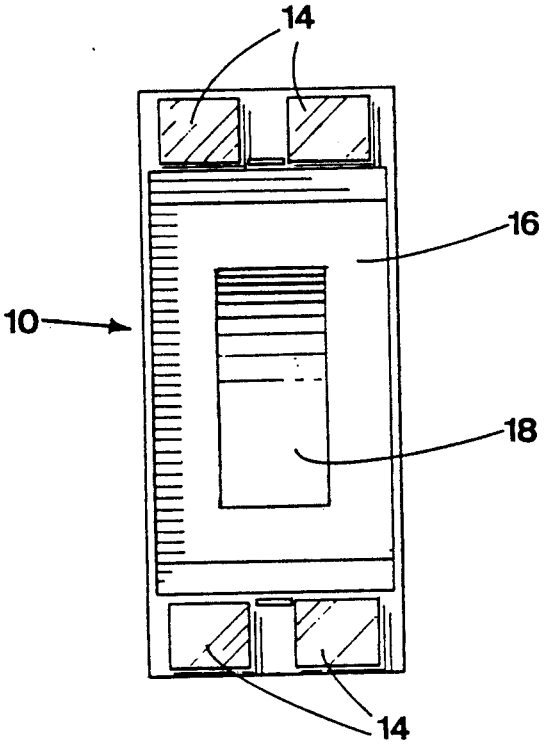
FIG. 3 is a back view of the embodiment of FIG. 1.
Figure 2:
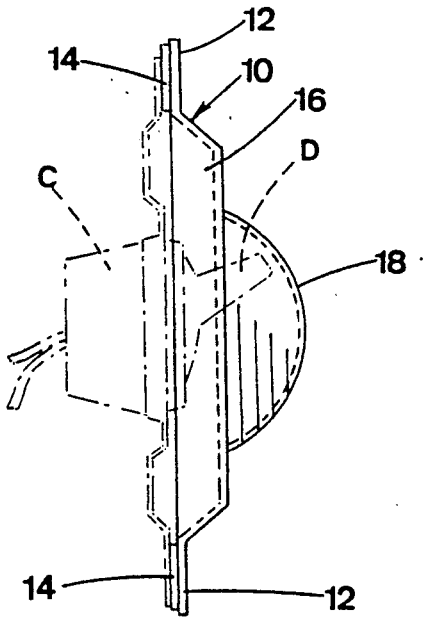
FIG. 2 is a side elevation of the embodiment of FIG. 1 in position over an electrical switch box shown in dashed outline.

Referring to FIGS. 1 and 2, there is shown a standard electrical outlet box A inserted substantially flush in a wall B. A standard electrical switch C is mounted within the box A in a conventional manner by means of bolts retaining the steel ears Ca of the switch C. This switch has a conventional lever type operating finger D. To protect the inside of the box and also the entire switch assembly, there is provided a cover element, indicated at 10, preferably made of plastic material molded in one piece. The cover element 10 is of generally rectangular shape, of dimensions slightly smaller than the wall plaque, not shown, normally covering the box A and which has been removed for painting. The element 10 has two end flat sections 12, at the back face of which are secured permanent flat magnet elements 14, which are adapted to contact and removably adhere the protecting cover directly to the ears Ca. The protecting cover 10 forms a first raised portion 16 adapted to spacedly overlie the body of the switch C, should the latter protrude from box A, and the raised portion 16 is in turn provided with a central second raised portion 18 adapted to spacedly overlie the actuating finger D of the switch. When the cover 10 is in place, it is obvious that no paint will soil not only the switch C but also the inside of the outlet box A and also the electrical wires connected to the switch. Also, dirt inside the box A cannot escape from the latter under the air pressure exerted by a painting gun. Obviously, the same cover 10 can be positioned over an electrical outlet.

Figure 4:
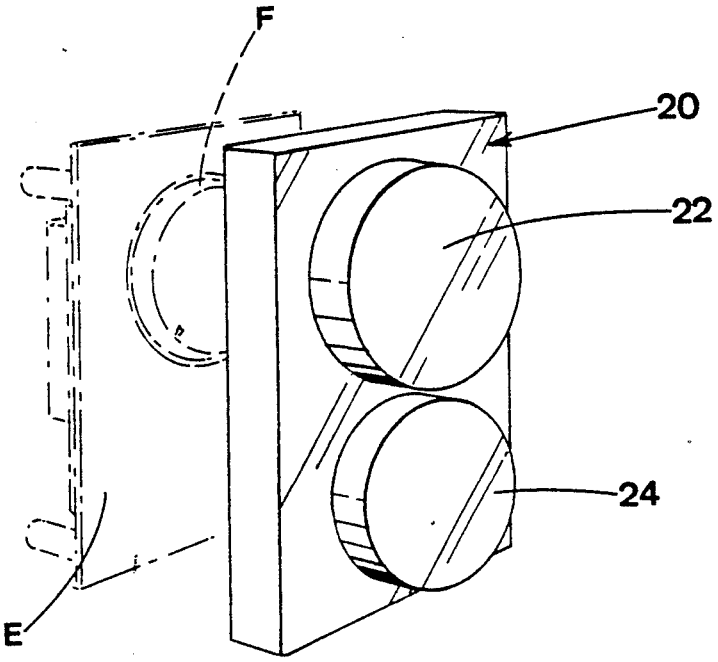
FIGS. 4, 5, and 6, are a perspective view, a side view, and a back view, respectively, of the second embodiment.
Figure 6:
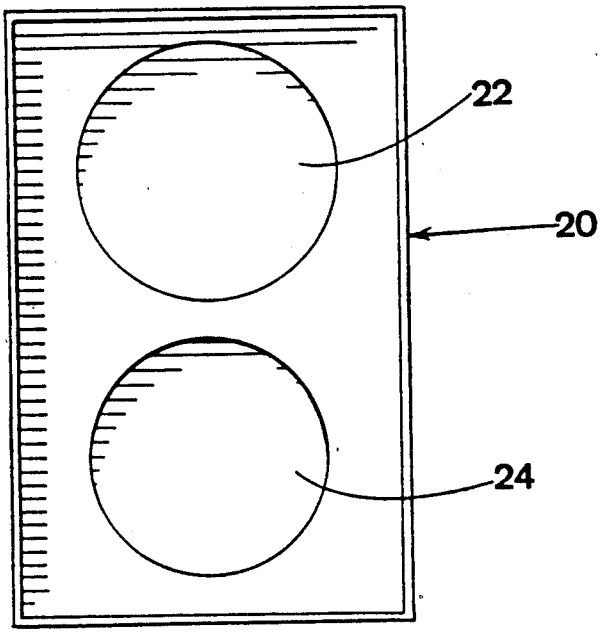
Figure 5:
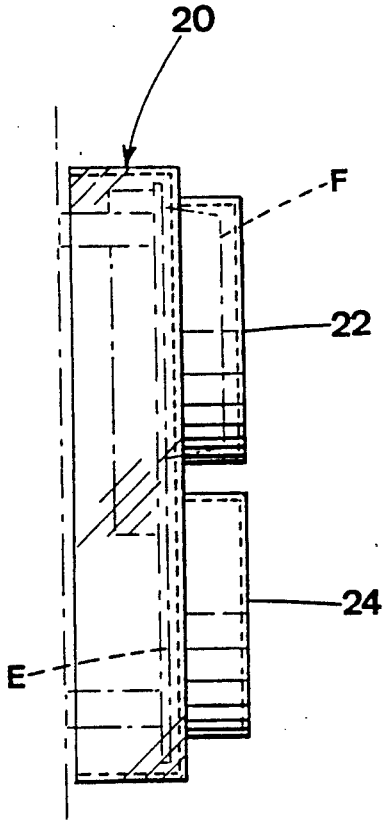

The second embodiment of the invention is shown in FIGS. 4 to 6. In this figure, there is shown a standard thermostat E, normally fixed inside a conventional outlet box A and protruding therefrom. To paint a room provided with a thermostat, the thermostat cover is first removed, thereby exposing the front face of the thermostat body and also its circular control knob F. In most places, these control knobs F come in two different standard sizes. The cover 20 in accordance with the second embodiment is of rectangular shape and forms a cup-like element to fit over the thermostat body E and is releasably retained over the same and also over the control knob F by any selected one of two raised central portions 22 or 24 of two different standard internal diameters to selectively frictionally fit over the control knob F in accordance with the size of the control knob to be covered.

I claim:

1. A cover for protecting an electrical outlet box and a room thermostat located within and secured to said box, said room thermostat having one of two standard size circular control knobs, said cover comprising a rectangularly-shaped cover element molded in one piece of a size smaller than the size of a standard wall plaque normally removably secured over an electrical outlet box for covering said room thermostat, said cover forming a box-like element open at the back and provided at the front with a pair of raised portions, of generally cylindrical shape and of two different diameters, each raised portion adapted to frictionally fit onto one of said two standard size control knobs.

* * * * *